US008519852B2

(12) United States Patent
Johnson et al.

(10) Patent No.: US 8,519,852 B2
(45) **Date of Patent: *Aug. 27, 2013**

(54) TWO-AXIS INCLINOMETER HEAD OF BED ELEVATION ALARM AND METHOD OF OPERATION

(75) Inventors: Michael David Johnson, Friendswood, TX (US); Robert Louis Clark, Jr., Johnston, IA (US)

(73) Assignee: Egression, LLC, Friendswood, TX (US)

( * ) Notice: Subject to any disclaimer, the term of this patent is extended or adjusted under 35 U.S.C. 154(b) by 163 days.

This patent is subject to a terminal disclaimer.

(21) Appl. No.: 13/073,194

(22) Filed: Mar. 28, 2011

(65) Prior Publication Data

US 2011/0234395 A1 Sep. 29, 2011

Related U.S. Application Data

(60) Provisional application No. 61/318,707, filed on Mar. 29, 2010.

(51) Int. Cl.
*G08B 1/08* (2006.01)

(52) U.S. Cl.
USPC ..... 340/573.7; 340/539.12; 340/573.1

(58) Field of Classification Search
USPC ..... 340/573.7, 539.12, 573.1
See application file for complete search history.

(56) References Cited

U.S. PATENT DOCUMENTS

| | | | | |
|---|---|---|---|---|
| 2,845,762 | A | 10/1958 | Wright | |
| 3,111,036 | A | 11/1963 | Kistler | |
| 3,806,109 | A | 4/1974 | Weber | |
| 3,962,693 | A | 6/1976 | Schamblin | |
| 4,102,055 | A | 7/1978 | Volk | |
| 4,306,456 | A | 12/1981 | Maerfeld | |
| 4,769,584 | A | 9/1988 | Irigoyen | |
| 5,006,487 | A | 4/1991 | Stokes | |
| 5,058,283 | A | 10/1991 | Wise | |
| 5,205,004 | A | 4/1993 | Hayes | |
| 5,611,096 | A | 3/1997 | Bartlett | |
| 5,715,548 | A | 2/1998 | Weismiller | |
| 5,923,263 | A * | 7/1999 | Rodriguez | 340/689 |
| 5,956,855 | A | 9/1999 | Foss | |
| 6,182,509 | B1 | 2/2001 | Leung | |
| 6,279,183 | B1 | 8/2001 | Kummer | |
| 6,353,949 | B1 | 3/2002 | Falbo | |
| 6,353,950 | B1 | 3/2002 | Bartlett | |
| 6,356,203 | B1 | 3/2002 | Halleck | |
| 6,505,365 | B1 | 1/2003 | Hanson | |
| 6,706,978 | B2 | 3/2004 | Wagatsuma | |
| 6,849,814 | B2 | 2/2005 | Ogden | |
| 7,117,607 | B2 | 10/2006 | Horgan | |

(Continued)

*Primary Examiner* — Travis Hunnings
(74) *Attorney, Agent, or Firm* — Hulsey, P.C.; William N. Hulsey; Loren T. Smith

(57) ABSTRACT

An apparatus used for reducing the incidence of aspiration in patients using a two-axis inclinometer is disclosed. The apparatus uses a two-axis inclinometer that is attached in the region of the patient's upper body to measure the absolute angular elevation of the patient's upper body, which is then transmitted to a display or other output device. In one embodiment, the instrument can be mounted to the head of a bed in a plurality of orientations and accurately measure the absolute angular elevation of the patient's upper body. In other embodiments the absolute angular elevation of the patient's upper body information is processed and transmitted to the nurses' station or to a data recorder. The disclosure also relates to a method for measuring the physical orientation of a patient, using such two-axis inclinometer apparatus.

18 Claims, 7 Drawing Sheets

(56) References Cited

U.S. PATENT DOCUMENTS

| | | | | |
|---|---|---|---|---|
| 7,319,386 | B2 | 1/2008 | Collins | |
| 7,346,944 | B2 | 3/2008 | Shaw | |
| 7,487,562 | B2 | 2/2009 | Frondorf | |
| 7,500,280 | B2 | 3/2009 | Dixon et al. | |
| 7,562,458 | B1 | 7/2009 | Clark | |
| 7,594,286 | B2 | 9/2009 | Williams | |
| 7,934,321 | B2 | 5/2011 | Johnson | |
| 2006/0021240 | A1* | 2/2006 | Horgan | 33/366.11 |
| 2007/0044237 | A1 | 3/2007 | Williams | |
| 2007/0143920 | A1* | 6/2007 | Frondorf et al. | 5/81.1 R |
| 2007/0268480 | A1* | 11/2007 | Kaye | 356/138 |
| 2009/0299229 | A1* | 12/2009 | Johnson et al. | 600/587 |

* cited by examiner

TWO-AXIS INCLINOMETER HEAD OF BED ELEVATION ALARM AND METHOD OF OPERATION

CROSS-REFERENCE TO RELATED APPLICATIONS

This application claims priority to U.S. Provisional Application Ser. No. 61/318,707, which is hereby incorporated by reference for all purposes.

FIELD

This disclosure relates generally to medical devices used to prevent aspiration and other complications in patients, and more specifically two-axis inclinometry devices used to warn caregivers about improper absolute angular orientation of a patient's upper body.

BACKGROUND

Hospitalized bedridden patients are at a high risk of aspirating and choking on secretions, food, medicines or gastric contents. These risks can be lowered by closely monitoring the absolute angular orientation of the patient's upper body. For example, patients on ventilators are especially vulnerable to developing severe pneumonia after aspirating gastric contents. Numerous studies have shown that such cases of pneumonia, known as ventilator-associated pneumonia, often can be prevented by elevating the plane of the upper body of the patient by approximately 30 degrees above the local horizontal plane. The plane of the upper body is defined as a plane that that passes through the line between the two shoulder joints and runs parallel with the spine. The local horizontal plane is defined as a plane normal to the local gravity vector. For the purposes of this disclosure it is assumed that the plane of the head of a hospital bed is parallel with the plane of the upper body and these terms may be used interchangeably.

While elevating the plane of the head of the bed is simple in principle, it is elusive in practice. This is because there are many reasons to lower the patient's upper body plane during the course of patient care. Some of these reasons include transport, bathing, or bedside medical procedures. Frequently, after the patient's upper body plane has been lowered for some reason and the caregiver forgets to elevate the head of the patient back in the elevated position. As a result, inadequate head elevation for at-risk patients is relatively common over the course of the treatment period. The disclosed subject matter helps to avoid this problem.

Known art, such as U.S. Pat. No. 7,117,607 by Horgan, discloses a device utilizing an "electronic inclinometer" to measure the head of bed angle to alert caregivers of dangerous head of bed angles for patients. However, known methods use a single axis inclinometer as the angle sensing device. These devices may suffer from the need for precise placement of the single sensing axis parallel with the head of bed axis of rotation.

Known art, such as U.S. Pat. No. 7,340,955 by Manninen, discloses a capacitive acceleration sensor arrangement that takes advantage of digital integration of the acceleration measurements. As quoted in Manninen:

"An advantage of the acceleration sensor measuring circuitry according to the present solution is the replacement of an analog integrator with a digital integrator, whereby the function of the circuit is unaffected by offset errors in the analog integrator. The integrators are also less sensitive to interference, in particular in the multiplexed application. The integrators can be implemented by means of modern sub-micron CMOS technology. The circuitry can also be designed to work at extremely low voltages, below 2.0 volts.

Sensitivity variations in connection with the processing of the sensor element can be calibrated away by adjusting the transfer function of the D/A converter. The digital output signal of the circuit is directly the output of the integrator, which can be transferred for further processing as a signal in either parallel or serial form. The power consumption of the D/A converter can achieve a very low level by means of CMOS technology (CMOS, Complementary Metal Oxide Semiconductor) by using the SC circuit technique (SC, Switched Capacitor).

A further advantage of the circuitry is the replacement of a charge amplifier by a fast comparator. The problem with a charge amplifier is the need for a large uniform range of operation because of the variation in sensor capacitances, as well as, in the multiplexing environment, a need for a wide bandwidth, which makes designing the charge amplifier a challenge and tends to increase the power consumption of the prestage. These problems largely disappear by means of a fast comparator."

SUMMARY

The disclosure relates to an improved apparatus for notifying a caregiver of the absolute angular orientation of the patient's upper body utilizing two-axis inclinometry. One method of creating a two-axis inclinometer is to utilize a three-orthogonal-axis accelerometer set. An advantage may be gained by utilizing a digitally integrated three-axis accelerometer set that consumes extremely low amounts of power and enables a battery powered head of bed alarm with extremely long battery life or, in some cases, could be powered by a small light energy power system.

The advantage of using two-axis inclinometry for an aftermarket head of bed sensor (or a permanently attached unit) is significant. A two-axis inclinometer permits arbitrary rotation of the two-axis inclinometer on the axis normal to the plane of the head of the bed. This permits the placement of the head of bed sensing unit on the plane of the head of bed by relatively unskilled personnel. In other words, in the case of a magnetically attached sensing unit, (or for that matter any other attachment means such as Velcro, adhesive, mechanical attachment, etc.) if the magnet plane (i.e. the two-axis inclinometer plane of reference) is parallel to the plane of the head of the bed, the unit can be arbitrarily placed about the axis normal to the plane of the magnet (i.e. the plane of the head of the bed). Thus, the user simply applies the unit to the plane of the head of the bed and it will be able to sense the inclination angle of the head of the bed without precise alignment by the user.

Other advantages offered by the method of incorporation of digital integration accelerometers for two-axis inclination measurement are significant when the power consumption levels of traditional analog integrating accelerometers are compared with the digital technology known in the art, such as that outlined in U.S. Pat. No. 7,340,955. Traditional MEMS accelerometers utilizing an analog integration method typically draw on the order of 180 μA of current. The devices outlined in U.S. Pat. No. 7,340,955 draw from 70 to 7 μA of current and in some cases, using a special switching algorithm, can reduce power consumption into the 1 μA region. In particular, Horgan's patent contemplated the use of an accelerometer based electronic inclinometer consuming on the order of 5.2 mA which is 5200 times the power consumption of the Manninen device. Thus the improvement of utilizing a digital versus analog integrating accelerometer based inclinometer enables the device to be battery powered with a battery life on the order of six months to one year using an off the shelf 9 volt battery (e.g. Eveready Energizer Part number 522).

In one embodiment, the apparatus includes a three-orthogonal-axis digital integrating accelerometer set for use as a two-axis inclinometer for attachment in the region of a hospital bed near a patient's upper body to measure the patient's absolute upper body elevation angle. That measurement is then displayed on a display device to indicate the proper or improper orientation of the patient's upper body. In one embodiment the three-orthogonal-axis digital integrating accelerometer set is attached to the hospital bed frame parallel to the plane of the head of the bed that supports the patient's upper body. In another embodiment the three-orthogonal-axis digital integrating accelerometer set is attached to the patient such that the sensing plane of the two-axis inclinometer is parallel with the patient's upper body plane. In one embodiment, the display is green when the patient's upper body orientation is favorable and red when the orientation is unfavorable. In another embodiment, the device includes a processor that allows the caregiver to arbitrarily install the three-orthogonal-axis digital integrating accelerometer set on a bed at any angle, initialize the horizontal level setting and measure the absolute angular orientation of the patient's upper body. In one embodiment, the apparatus sends the patient's upper body orientation information to a nurse's station.

In another embodiment a tilt switch with a ball housed in a cone shaped cup is used as a two-axis inclinometer for attachment in the region of a hospital bed near a patient's upper body to sense if the patient's absolute upper body elevation angle is above or below a predetermined angle, that angle being determined by the angle of the cone shaped cup in the tilt switch. That state is then displayed on a display device to indicate the proper or improper orientation of the patient's upper body. In one embodiment the tilt switch is attached to the hospital bed frame parallel to the plane of the head of the bed that supports the patient's upper body. In another embodiment the tilt switch is attached to the patient such that the sensing plane of the two-axis inclinometer tilt switch is parallel with the patient's upper body plane. In one embodiment, the display is green when the patient's upper body orientation is favorable and red when the orientation is unfavorable. In another embodiment, the device includes a processor that allows the caregiver to arbitrarily install the two-axis inclinometer tilt switch on a bed at any rotation angle, and measure the absolute angular orientation of the patient's upper body. In one embodiment, the apparatus sends the patient's upper body orientation information to a nurse's station.

This disclosure also relates to a method for measuring the absolute angular orientation of a patient's upper body plane. In one embodiment, the absolute angular orientation of a patient's upper body plane is measured using a two-axis inclinometer comprising a three-orthogonal-axis digital integrating accelerometer set and then displayed on a display unit. In another embodiment the display unit presents a single color to indicate the correct absolute angular orientation of a patient's upper body. In another embodiment the display unit presents a single color to indicate the incorrect absolute angular orientation of a patient's upper body. In another embodiment the absolute angular orientation of a patient's upper body information is transmitted to a processor. In still another embodiment, the apparatus transmits the absolute angular orientation of a patient's upper body information to a nurses' station. In another embodiment the processor is programmed to alert the caregiver of a plurality of alarm conditions.

Additional advantages will be set forth in part in the description which follows, and in part will be obvious from the description, or may be learned by practice of the aspects of the disclosure as described herein. The advantages can be realized and attained by means of the elements and combinations particularly pointed out in the appended claims. It is to be understood that both the foregoing general description and the following detailed description are exemplary and explanatory only and are not restrictive of the aspects of the disclosure, as claimed.

BRIEF DESCRIPTION OF THE DRAWINGS

The features, nature, and advantages of the disclosed subject matter will become more apparent from the detailed description set forth below when taken in conjunction with the accompanying drawings, wherein.

DETAILED DESCRIPTION

Figure 1A:
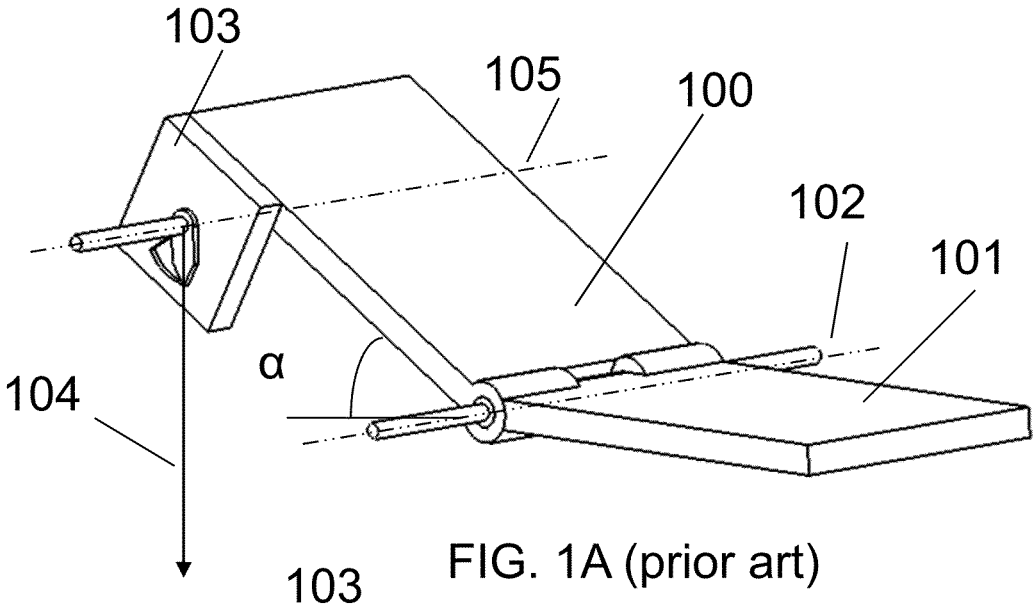
FIG. 1A (prior art)
FIGS. 1A through 1C are diagrams illustrating the prior art single axis inclinometry method of measuring the head of bed angle.

The present disclosure may be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

As used in the specification and the appended claims, the singular forms "a," "an" and "the" include plural referents unless the context clearly dictates otherwise. Thus, for example, reference to an "analyzer" can include two or more such analyzers unless the context indicates otherwise.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Reference will now be made in detail to certain embodiments of the disclosure, examples of which are illustrated in the accompanying drawings. Wherever possible, the same reference numbers are used throughout the drawings to refer to the same or like parts.

The utilization of a two-axis inclinometer enables the disclosed device to be placed in any arbitrary rotational orientation on the plane of the head of a hospital bed such that the unit will accurately measure the head of the bed in relation to the local horizontal plane (i.e. the plane normal to the local gravity vector). For example, the device could be affixed to the metal underside of a hospital bed by a magnet where the magnet is parallel to the plane of the head of the hospital bed but the unit is not constrained to any particular rotation around an axis normal to the head of the bed plane. The same unit could be placed on the top side of the head of bed by simply modifying the software to accommodate an angular range of interest opposite of that on the underside of the head of bed plane. The unit will perform the same function even though the orientation of the unit with respect to the bed is 180 degrees opposite that from the underside of bed use. As such, the device could be placed on either side of the bed, on top, bottom in any orientation so long as the two-axis inclinometer is parallel with respect to the head of bed plane.

Figure 1B:
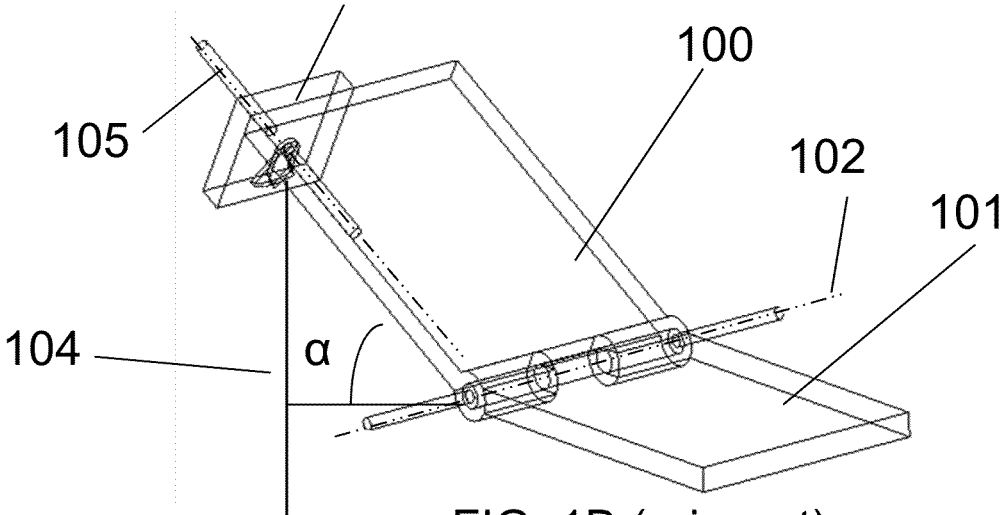
FIG. 1B (prior art)
Figure 1C:
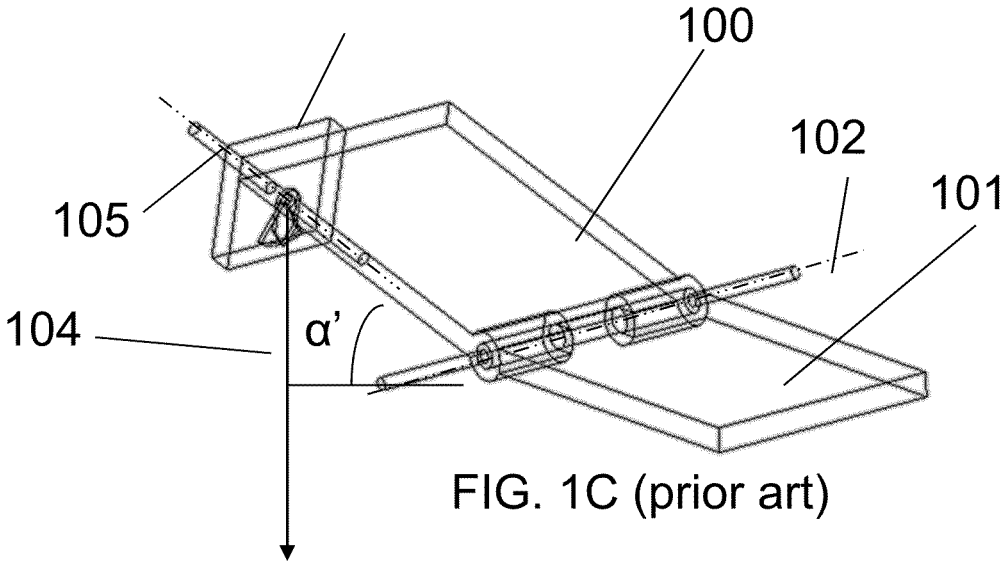
FIG. 1C (prior art)

FIGS. 1A through 1C illustrate the geometrical operating principle of prior art single axis inclinometry as applied to head of bed monitoring. In FIG. 1A, head of bed plane 100 rotates about bed axis 102 and is attached to foot of bed plane 101. Single axis inclinometer 103 has an angle measuring axis 105 that measures the angle between the local gravity vector 104 and the head of bed plane 100. This angle is equal to α. Single axis inclinometer 103 is designed such that it alerts a caregiver in the event that head of bed plane 100 is above or below a predetermined angle relative to local gravity vector 104. It is critical that single axis inclinometer 103 angle measuring axis 105 is parallel to bed axis 102 for the unit to measure angle α correctly.

FIG. 1B illustrates when single axis inclinometer 103 is not properly aligned with bed axis 102. When single axis inclinometer 103 angle measuring axis 105 is not parallel to bed axis 102, measuring errors are increased as the angle between single axis inclinometer 103 angle measuring axis 105 increases to a maximum error at 90 degrees. In fact, when single axis inclinometer 103 angle measuring axis 105 is at 90 degrees from bed axis 102, single axis inclinometer 103 is no longer able to measure angle α a at all.

FIG. 1C illustrates when head of bed plane 100 is lowered while single axis inclinometer 103 angle measuring axis 105 is at 90 degrees to bed axis 102 that single axis inclinometer 103 no longer measures angle α.

Figure 2A:
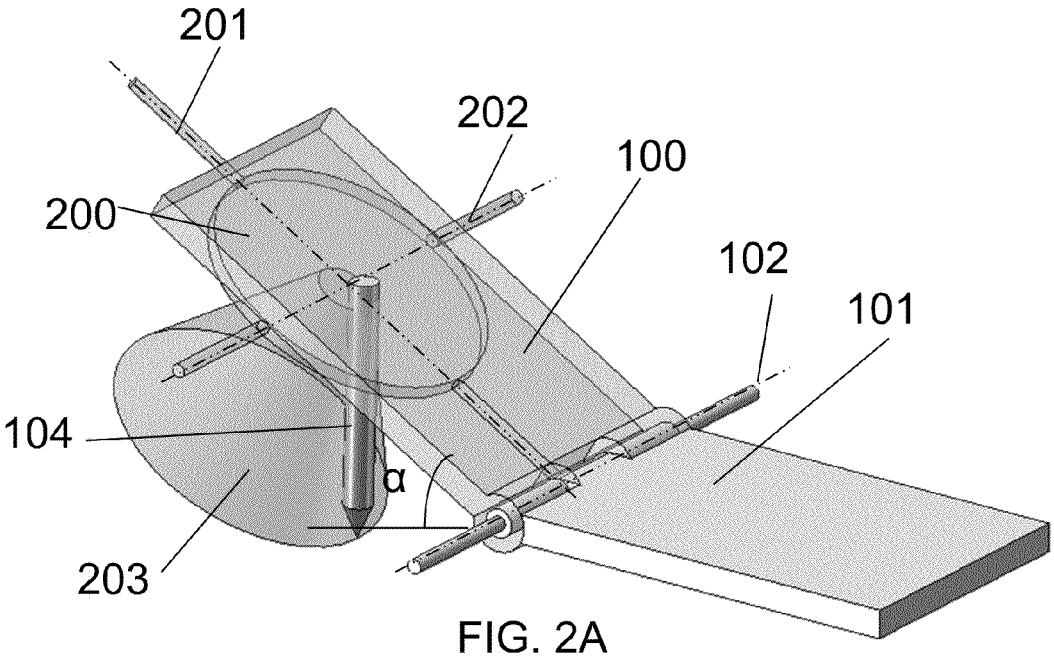
FIGS. 2A and 2B are diagrams illustrating a device using a two-axis inclinometry method of measuring the head of bed angle in accordance with the present disclosure.

FIG. 2A illustrates the geometrical operating principle of two-axis inclinometry as applied to head of bed monitoring. The head of bed plane 100 rotates about bed axis 102 and is attached to foot of bed plane 101. Two-axis inclinometer 200 has two angle measuring axes 201 and 202 that measure and (with an appropriate algorithm well known in the art) calculate the angle between the local gravity vector 104 and the head of bed plane 100. This angle is equal to α. Two-axis inclinometer 200 is designed such that it alerts a caregiver in the event that head of bed plane 100 is above or below a predetermined angle (angle cone 203) relative to local gravity vector 104.

Figure 2B:
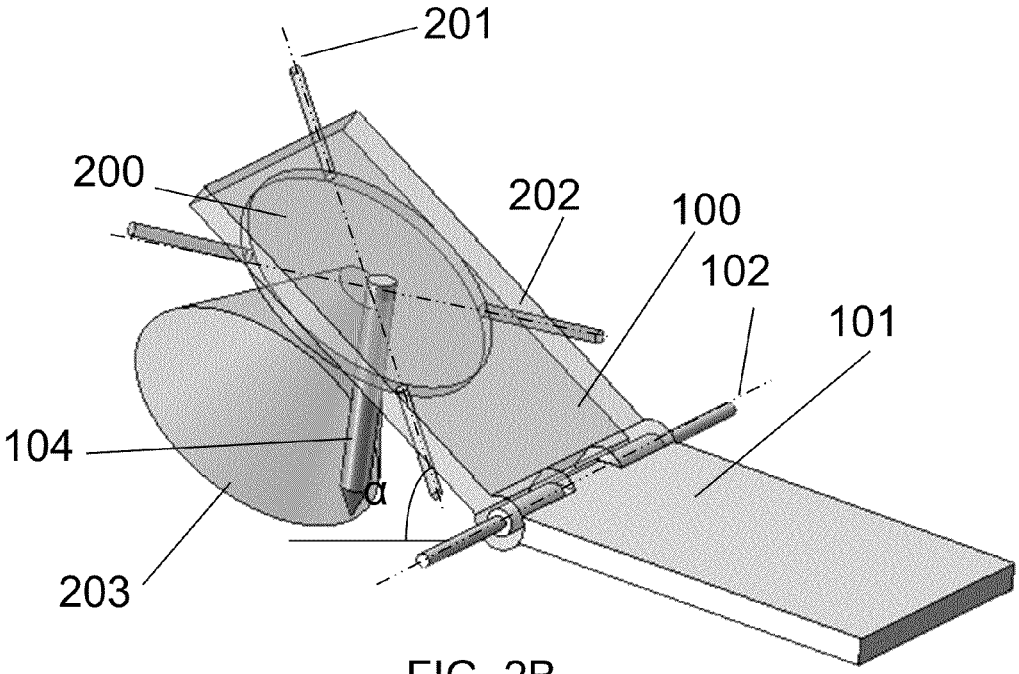

FIG. 2B illustrates when two-axis inclinometer 200 angle measuring axes 201 and 202 are not properly aligned with bed axis 102. A surprising effect is when both of two-axis inclinometer 200 angle measuring axes 201 and 202 are not parallel to bed axis 102 the calculated angle between gravity vector 104 and head of bed plane 100 is absolutely unaffected. This curious property is extremely useful for aftermarket head of bed alarms that are operated by unskilled workers. In fact, it is obvious that any worker may simply place two-axis inclinometer 200 on head of bed plane 100 in any orientation so long as two-axis inclinometer 200 is coplanar with bed plane 100 that the unit will accurately measure the inclination angle α regardless of orientation of axes 201 and 202 relative to bed axis 102. Two-axis inclinometer 200 is designed such that it alerts a caregiver in the event that head of bed plane 100 is above or below a predetermined angle (angle cone 203) relative to local gravity vector 104.

Figure 3:
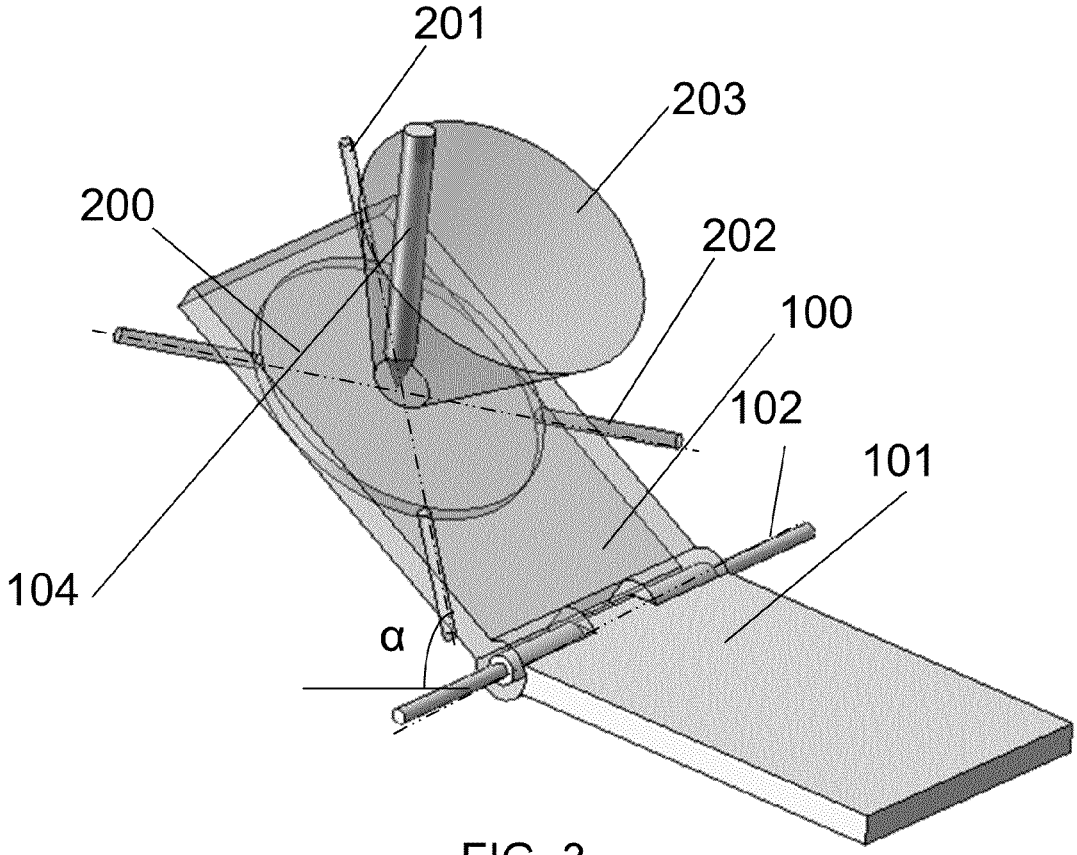
FIG. 3 is a diagram illustrating a device using a two-axis inclinometry method of measuring the head of bed angle in accordance with the present disclosure.

FIG. 3 illustrates when two-axis inclinometer 200 is placed on the upper side of head of bed plane 100. In addition, neither of two-axis inclinometer 200 angle measuring axes 201 and 202 is parallel with bed axis 102. A further surprising effect is when two-axis inclinometer 200 is placed on the top of head of bed plane 100 and the algorithm used to calculate the angle α is such that, mathematically speaking, the angles are absolute in value (i.e. |−30 degrees|=30 degrees) two-axis inclinometer 200 will function identically as if it were placed on the lower side of head of bed plane 100. This is due to the fact that, in this orientation, the direction of gravity vector 104 is exactly opposite relative to two-axis inclinometer 200 sensing. Also, even though angle measuring axes 201 and 202 are not parallel to bed axis 102 the calculated angle α between gravity vector 104 and head of bed plane 100 is absolutely unaffected. This additional curious property is once again extremely useful for aftermarket head of bed alarms that are operated by unskilled workers. In fact, it is obvious that any worker may simply place two-axis inclinometer 200 on either side of head of bed plane 100 in any orientation so long as two-axis inclinometer 200 is coplanar with bed plane 100 that the unit will accurately measure the inclination angle α regardless of orientation of axes 201 and 202 relative to bed axis 102 or of the side of placement on head of bed plane 100. Two-axis inclinometer 200 is designed such that it alerts a caregiver in the event that head of bed plane 100 is above or below a predetermined angle (angle cone 203) relative to local gravity 104.

Head of bed angle α is especially important for bedridden patients for a variety of reasons. For example, for a patient connected to a ventilator, ventilator-associated pneumonia can be reduced by maintaining the upper body of the ventilated patient at an angle of thirty degrees or greater. In one embodiment, the apparatus is programmed to alert the hospital staff when the upper body of a patient on the ventilator is below 30 degrees. In one embodiment, the display color is solid green when the patient's upper body is 30 degrees or greater. When the upper body is under 30 degrees, the display is colored blinking red. An additional embodiment uses sound as the alarm mechanism, such as a bell, horn or tone. In another embodiment, the words "Ventilated Patients Beds Must be Elevated to at Least 30 Degrees" are printed by the display.

The disclosed subject matter is also useful for patients who have recently had strokes, are weak, or have a high risk of inhaling their food and drink. Any of these situations can lead to a possibly fatal event of the patient choking on food, saliva, or other bodily fluids or substances. The apparatus can be set to aspiration precautions, which instructs the caregiver to elevate the head of the bed to 45 or 60 degrees when the patient is eating or drinking or to any arbitrary angle setting.

Additionally, the patient can develop pressure sores on the buttocks and lower back when the angle is much higher than 30 to 35 degrees. Therefore, in another embodiment, the apparatus can be programmed to display an alarm when the patient's upper body has been above 35 degrees in excess of the pre-programmed time. In another embodiment, the display contains selection buttons: one for a mobile patient which has no limit for time above 35 degrees, and another for an immobilized patient which is set to a maximum time (e.g. 15 minutes) above 35 degrees or other predetermined angle.

Figure 4:
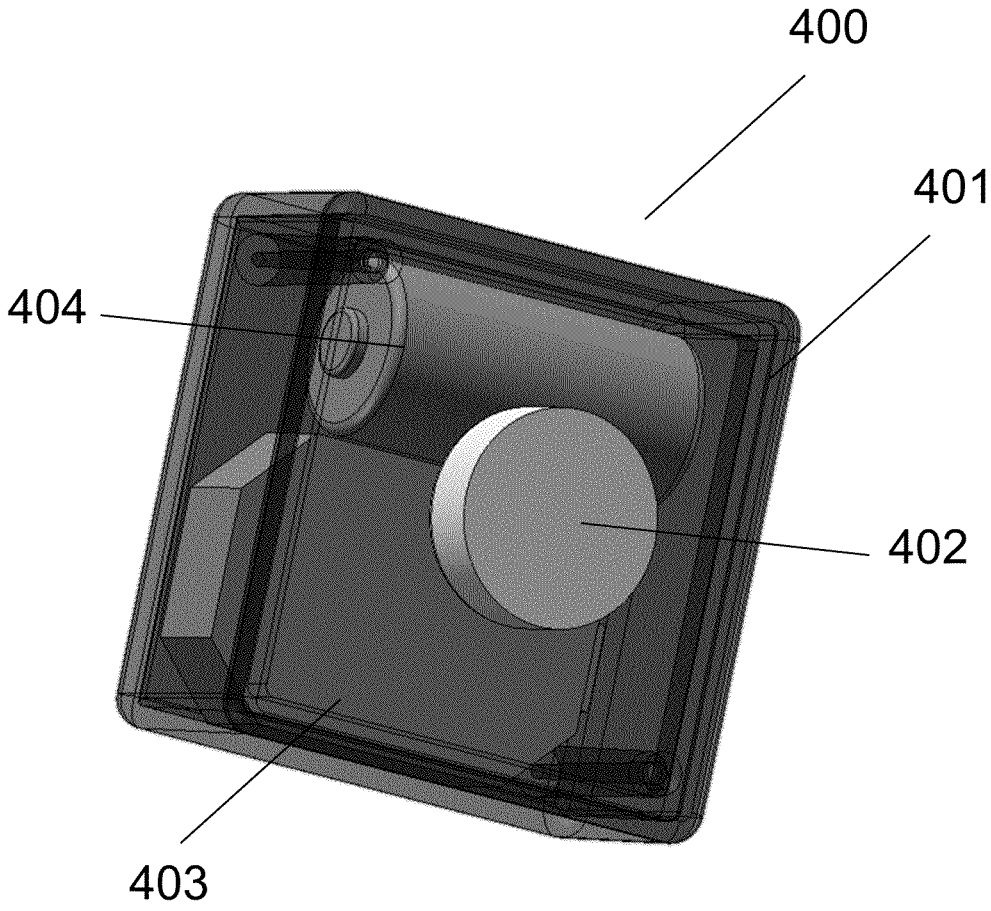
FIG. 4 is a transparent view of a device in accordance with the present disclosure.

FIG. 4 depicts another embodiment of the disclosed subject matter. In this embodiment, two-axis inclinometer head of bed alarm 400 is contained in a housing 401 that is connected to magnet 402. Magnet 402 is intended to adhere to head of bed plane 100 and be parallel with this plane. Electronic module 403 is a multipurpose device that contains at least a three-axis accelerometer (which functions as a two-axis inclinometer), a microcontroller with appropriate software and algorithms to calculate the two-axis inclinometry angles, a wireless transceiver (e.g. WiFi transceiver), and power management electronics. An example of such a commercially available device is the Texas Instruments ez430-Chronos module. Battery 404 functions as an internal power supply for electronics module 403.

Figure 5:
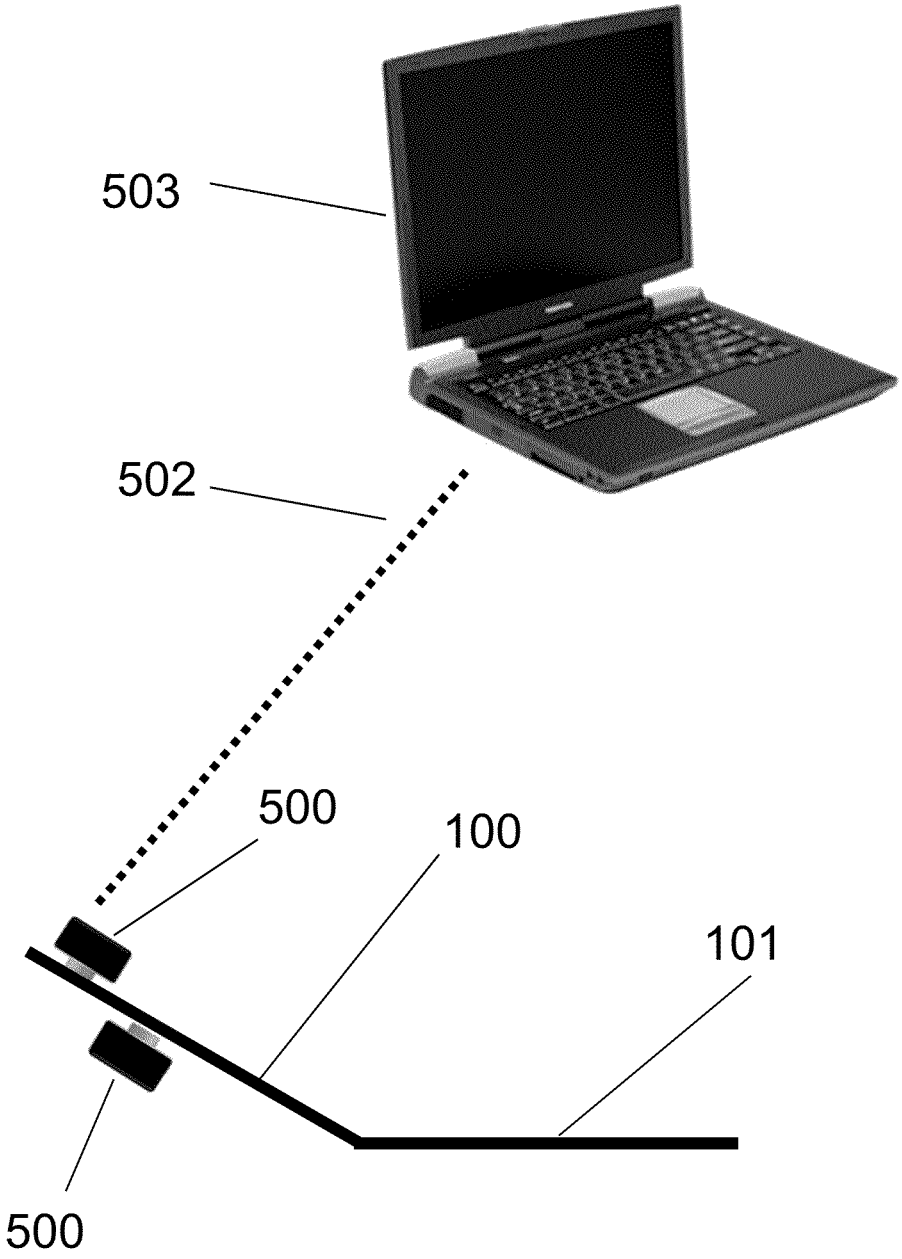
FIG. 5 depicts operation of a device in accordance with the present disclosure.

FIG. 5 illustrates how two-axis inclinometer head of bed alarm 500 is simply attached to the top or bottom of head of bed plane 100 by magnet 402. Since electronics module 403 utilizes very little power, there is no power switch so it is impossible to forget to turn the unit off. Radio signal 502 (e.g. WiFi) communicates with remote computer 503. The device can function in a multiplicity of ways. For example, the software to calculate the inclinometry angles can be resident on electronics module 403 or it can be on remote computer 503. Angle alarm settings can also be either resident on the electronics module 403 software or on remote computer 503. The device can also transmit a battery status indication to remote computer 503. Remote computer 503 can be located at a central nurse's station or at a remote monitoring center that is in communication with head of bed alarm 500, e.g. via Internet or computer network.

Figure 6A:
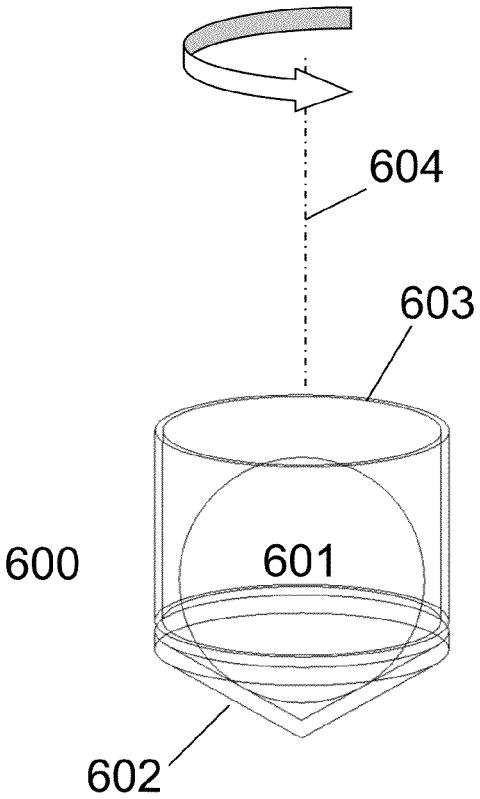
FIGS. 6A and 6B depict a two axis tilt switch version of a device in accordance with the present disclosure.

FIG. 6A illustrates how two-axis tilt switch 600 can serve as the inclination sensor for two axis inclinometer head of bed alarm 500. Tilt switch 600 comprises metal ball 601, conic electrode 602, and cylindrical electrode 603. The cone angle of conic electrode 602 is equal to the desired angle of activation (e.g. 30 degrees) of head of bed plane 100 perpendicular to axis 604. It is clear that tilt switch 600 can be rotated about axis 604 as indicated by the arrow without affecting the desired angle of activation. Ball 601 is not in contact with cylindrical electrode 603 when tilt switch 600 is below the activation angle. This state of switch 600 causes a warning signal to be sounded by two-axis inclinometer head of bed alarm 500 to alert the caregiver that head of bed plane 100 is too low.

Figure 6B:
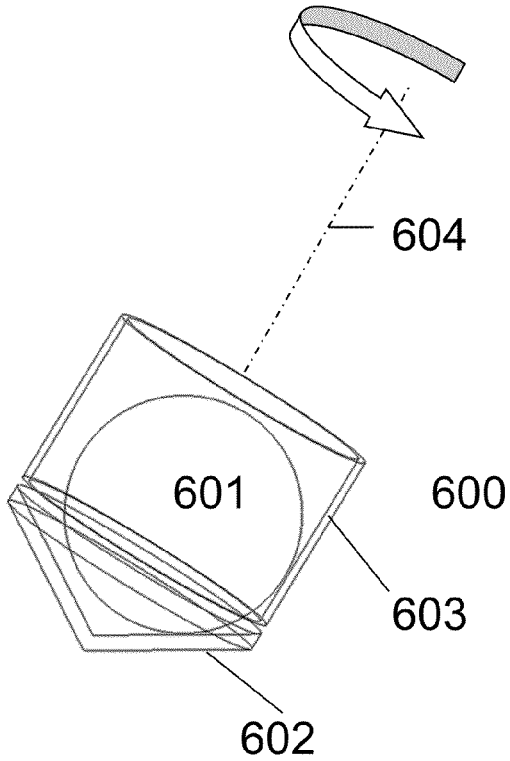

FIG. 6B illustrates how two axis tilt switch 600 is activated when switch 600 and head of bed plane 100 is rotated above the angle of activation (e.g. 30 degrees). Metal ball 601 rolls in conic electrode 602 and contacts both cylindrical electrode 603 and conic electrode 602, thus completing an electrical circuit, which causes two-axis inclinometer head of bed alarm 500 to stop sounding a warning signal.

Remote computer 503 can also be an interconnected device such as a tube feeding pump or ventilator. In the example of the tube feeding pump, the tube feeding pump would sound an alarm and cease to operate if the head of bed were below say, 30 degrees.

The display on computer 503 alerts the user to the orientation of the patient's upper body and warns if the orientation is incorrect. In one embodiment, the electronics module 403 may be a solid state device that produces digital signals, which drive the display. The display on computer 503 is in one embodiment an LCD screen, a set of lights, an on or off display, or any number of forms that may be used to alert the user. In another embodiment, the user can continuously view the display screen to offer the user a constant reminder regarding the patient's upper body orientation. In another embodiment, the display can be all analog to show patient upper body orientation or minimum upper body orientation and can trigger the appropriate light when the upper body orientation meets any one of the other preset alarm conditions.

In one embodiment, the output of electronics module 403 or computer 503 is sent to an input channel of a ventilator. In another embodiment, the processor in electronics module 403 transmits the patient upper body orientation information to a network adapter and then to a Wi-Fi transceiver or to an Ethernet connection, which then relays the orientation information to various other devices and locations. In one such embodiment, the information is relayed to the nurses' station. In another embodiment, the patient orientation information is relayed to a personal digital assistant. In still another embodiment, the patient orientation information is relayed to a cell phone. In yet another embodiment, the patient orientation information can be relayed to the nurse call system, enabling the processor to call the nurse to the patient's room. In another embodiment, the processor can be programmed to alert the user at different settings or alarm conditions.

In another embodiment, the two-axis inclinometer is attached to the patient's body directly instead of to the head of bed plane 100. In the home care setting, the caregiver may use pillows rather than a mechanical bed to elevate the patient's upper body. Having the inclinometer attached to the patient's body, the caregiver can maintain correct head elevation without the use of a mechanical bed.

In one embodiment, the electronics module 403 processor calculates the patient upper body orientation value from the three-axis accelerometer (two-axis inclinometer) in electronics module 403. The processor then checks to see if the patient upper body orientation value is above or below the set value for the alarm condition. If the alarm condition is met, the processor sends a signal to an alarm mechanism (e.g. remote computer 503). If the alarm condition is not met, the electronics module 403 continues to monitor the angle of the head of bed plane 100 using two-axis inclinometry. In various embodiments, the alarm can be verbal, audio, visual, a display change, a light, or a warning to another set of devices.

In another embodiment the caregiver can input into the two-axis inclinometer apparatus an angle of inclination of the patient's upper body and the amount of time the patient may be non-detrimentally in that orientation or the amount of time the patient may rest outside of the allowed orientation on, for example, remote computer 503. When the patient's upper body is at the set orientation or outside the required orientation, a timer starts to run. When the patient is in the set orientation or outside the preferred orientation longer than the amount of time set by the caregiver, the apparatus sends an alarm. Thus, when the angle is changed for a medical reason, the apparatus can record when the patient's orientation is not in the desired orientation range and alert the caregiver when the patient is at that orientation for a detrimental amount of time.

It will be apparent to those skilled in the art that various modifications and variations can be made in the present disclosure without departing from the scope or spirit of the disclosure. Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. An angular elevation notification system comprising:

a two-axis inclinometer capable of being attached to a surface of an upper portion of a bed, wherein said two-axis inclinometer is substantially unaffected in operation by an arbitrary rotation about an axis perpendicular to said surface, said two-axis inclinometer operable to detect an angle between said surface and a local gravity vector; and a notification device coupled to said two-axis inclinometer and operable to alert a caregiver if said angle is outside of a predetermined range.

2. The angular elevation notification system of claim 1, wherein said notification device comprises a display operable to display a first color when said angle is inside said predetermined range and a second color when said angle is outside said predetermined range.

3. The angular elevation notification system of claim 1, wherein said notification device comprises an auditory alert.

4. The angular elevation notification system of claim 1, wherein said notification device is coupled to a remote nurse station.

5. The angular elevation notification system of claim 1, wherein said notification device is operable to alert said caregiver if said angle is outside said predetermined range for longer than a predetermined length of time.

6. The angular elevation notification system of claim 1, wherein said notification device is operable to transmit a notification to a mobile phone if said angle is outside said predetermined range.

7. The angular elevation notification system of claim 6, wherein said notification device is operable to transmit said notification to said mobile phone if said angle is outside said predetermined range for longer than a predetermined length of time.

8. The angular elevation notification system of claim 1, wherein said two-axis inclinometer further comprises a magnet for attachment to said surface.

9. The angular elevation notification system of claim 1, wherein said two-axis inclinometer comprises a tilt switch comprising an electrically conductive ball housed in a cone-shaped cup, wherein said cone-shaped cup has a cone axis perpendicular to said surface of said upper portion of said bed.

10. A method for alerting a caregiver of an improper patient orientation, said method comprising:

coupling a two-axis inclinometer to an upper portion of a patient bed, wherein said two-axis inclinometer may be arbitrarily rotated about an axis perpendicular to said upper portion of said patient bed;

measuring an angle between a local gravity vector and an upper body of a patient via said two-axis inclinometer;

determining if said angle is outside a predetermined range; and alerting said caregiver if said angle is outside said predetermined range.

11. The method of claim 10, wherein said alerting step comprises alerting via a display operable to display a first color when said angle is inside said predetermined range and a second color when said angle is outside said predetermined range.

12. The method of claim 10, wherein said alerting step comprises alerting via an auditory alert.

13. The method of claim 10, wherein said alerting step comprises alerting a caregiver at a remote nurse station.

14. The method of claim 10, wherein said alerting step comprises alerting said caregiver if said angle is outside said predetermined range for longer than a predetermined length of time.

15. The method of claim 10, wherein said alerting step comprises transmitting a notification to a mobile phone if said angle is outside said predetermined range.

16. The method of claim 15, wherein said alerting step comprises transmitting said notification to said mobile phone if said angle is outside said predetermined range for longer than a predetermined length of time.

17. The method of claim 10, wherein said step of coupling said two-axis inclinometer to said upper portion of said patient bed comprises attaching said two-axis inclinometer to said upper portion of said patient bed via a magnet.

18. The method of claim 10, wherein said two-axis inclinometer comprises a tilt switch comprising an electrically conductive ball housed in a cone-shaped cup, wherein said cone-shaped cup has a cone axis perpendicular to said surface of said upper portion of said bed.

* * * * *